US009285164B2

(12) United States Patent
Wilhelm

(10) Patent No.: US 9,285,164 B2
(45) Date of Patent: Mar. 15, 2016

(54) COLD BOX SHEET METAL JACKET

(75) Inventor: Stefan Wilhelm, Unterhaching (DE)

(73) Assignee: LINDE AKTIENGESELLSCHAFT, Munich (DE)

( * ) Notice: Subject to any disclaimer, the term of this patent is extended or adjusted under 35 U.S.C. 154(b) by 3405 days.

(21) Appl. No.: 10/520,132

(22) PCT Filed: Jun. 24, 2003

(86) PCT No.: PCT/EP03/06650
§ 371 (c)(1),
(2), (4) Date: Dec. 5, 2005

(87) PCT Pub. No.: WO2004/005651
PCT Pub. Date: Jan. 15, 2004

(65) Prior Publication Data

US 2006/0162379 A1 Jul. 27, 2006

(30) Foreign Application Priority Data

Jul. 2, 2002 (DE) ..... 102 29 663

(51) Int. Cl.

| | |
|---|---|
| ***F25J 3/04*** | (2006.01) |
| ***E04C 2/38*** | (2006.01) |
| ***E04B 1/24*** | (2006.01) |
| ***E04B 1/08*** | (2006.01) |
| ***E04H 5/10*** | (2006.01) |

(Continued)

(52) U.S. Cl.
CPC ..... *F25J 3/04945* (2013.01); *E04B 1/08* (2013.01); *E04B 1/24* (2013.01); *E04C 2/384* (2013.01); *E04C 2/40* (2013.01); *E04H 5/10* (2013.01); *E04H 7/04* (2013.01); *E04H 7/30* (2013.01); *F25J 3/0489* (2013.01); *F25J 2290/42* (2013.01)

(58) Field of Classification Search
CPC ..... E04H 5/10; E04H 7/04; E04B 1/24; E04B 1/08; E04C 2/70; E04C 2/384; F25J 3/0489; F25J 3/04945; F25J 2290/42
USPC ..... 62/643, 902, 907, 259.1; 52/79.1, 52/79.12, 506.03, 481.1, 474, 479, 483.1; 220/560.04, 592.2
See application file for complete search history.

(56) References Cited

U.S. PATENT DOCUMENTS 2,181,074 A * 11/1939 Scott ..... 52/404.1
2,231,216 A * 2/1941 Nystrom ..... 52/787.11

(Continued)

FOREIGN PATENT DOCUMENTS

BE 1002542 3/1991
BE 10002542 * 3/1991

(Continued)

OTHER PUBLICATIONS

Machine translation of German patent DE 648528.*

(Continued)

*Primary Examiner* — John F Pettitt
(74) *Attorney, Agent, or Firm* — Millen, White, Zelano, Branigan, P.C.

(57) ABSTRACT

The invention relates to an enclosure for parts of a low-temperature air separation system. The side walls extending perpendicular to the base surface of the enclosure are each lined with a sheet metal jacket consisting of several panels (1*a*, 1*b*, 2*a*, 2*b*). The joints of the panels (1*a*, 1*b*, 2*a*, 2*b*) of a side wall all have the same distance from one another.

25 Claims, 3 Drawing Sheets

(51) Int. Cl.

| | |
|---|---|
| ***E04C 2/40*** | (2006.01) |
| ***E04H 7/04*** | (2006.01) |
| ***E04H 7/30*** | (2006.01) |

(56) References Cited

U.S. PATENT DOCUMENTS

| | | | | | |
|---|---|---|---|---|---|
| 2,256,375 | A | * | 9/1941 | Bonsall | 52/404.3 |
| 2,323,297 | A | | 7/1943 | Collins | |
| 2,507,379 | A | * | 5/1950 | Morrison | 62/294 |
| 2,934,934 | A | * | 5/1960 | Berliner | 52/601 |
| 3,070,196 | A | * | 12/1962 | Switzgable, Jr. | 52/404.4 |
| 3,754,675 | A | * | 8/1973 | Richard et al. | 220/560.06 |
| 3,797,190 | A | * | 3/1974 | Widdowson | 52/592.4 |
| 4,021,982 | A | * | 5/1977 | Kotcharian | 52/410 |
| 4,047,340 | A | * | 9/1977 | Witte et al. | 52/169.7 |
| 4,124,960 | A | * | 11/1978 | Bush et al. | 52/245 |
| 4,316,351 | A | * | 2/1982 | Ting | 52/309.9 |
| 4,331,252 | A | * | 5/1982 | Carren et al. | 220/4.17 |
| 4,633,634 | A | * | 1/1987 | Nemmer et al. | 52/474 |
| 4,700,520 | A | * | 10/1987 | Ting | 52/478 |
| 4,739,597 | A | * | 4/1988 | Voegeli et al. | 52/223.7 |
| 4,910,932 | A | * | 3/1990 | Honigman | 52/280 |
| 4,914,874 | A | * | 4/1990 | Graham, Jr. | 52/79.1 |
| 5,236,625 | A | * | 8/1993 | Bardo et al. | 261/24 |
| 5,461,871 | A | * | 10/1995 | Bracque et al. | 62/643 |
| 5,524,400 | A | * | 6/1996 | Schmechel | 52/474 |
| 5,548,933 | A | * | 8/1996 | Sharma et al. | 52/192 |
| 5,640,824 | A | * | 6/1997 | Johnson et al. | 52/578 |
| 5,657,583 | A | * | 8/1997 | Tennant | 52/79.5 |
| 5,782,047 | A | * | 7/1998 | De Quesada | 52/236.6 |
| 5,875,599 | A | * | 3/1999 | McGrath et al. | 52/586.2 |
| 6,035,795 | A | * | 3/2000 | Dhellemmes et al. | 114/74 A |
| 6,119,481 | A | | 9/2000 | Sunder | |
| 6,167,723 | B1 | * | 1/2001 | Guillard | 62/646 |
| 6,298,617 | B1 | * | 10/2001 | de Quesada | 52/236.3 |
| 6,360,545 | B1 | * | 3/2002 | Goldstone et al. | 62/45.1 |
| 6,941,718 | B1 | * | 9/2005 | diGirolamo et al. | 52/695 |

FOREIGN PATENT DOCUMENTS

| | | | | |
|---|---|---|---|---|
| DE | 648528 | | * | 8/1937 |
| DE | 19620686 | | * | 11/1997 |
| EP | 0 309 033 | B1 | | 5/1991 |
| EP | 0 930 096 | A2 | | 7/1999 |
| FR | 2484502 | | | 12/1981 |
| FR | 2701983 | | * | 9/1994 |
| FR | 2701984 | | * | 9/1994 |
| GB | 860918 | | | 2/1961 |
| GB | 2076037 | | | 11/1981 |
| GB | 2339440 | | | 1/2000 |
| JP | 11-172962 | A | | 6/1999 |

OTHER PUBLICATIONS

Baukal, Charles, E. Jr., "Oxygen-Enhanced Combustion", pp. 73,74, 120, 121, published in 1998 by CRC Press LLC, United States.

* cited by examiner

COLD BOX SHEET METAL JACKET

The invention relates to an enclosure for parts of a low-temperature air separation system that has side walls that extend perpendicular to the base surface of the enclosure, the extension of the enclosure perpendicular to the base surface defining its height, and the side walls each being lined with a sheet metal jacket consisting of several panels. Furthermore, the invention relates to a process for producing an enclosure that has side walls that extend perpendicular to the base surface of the enclosure.

In low-temperature air separation by rectification, the batch air to be separated is cooled beforehand and at least partially liquefied. The air is then separated by rectification into one or more columns at temperatures of roughly 100 K.

For thermal insulation, the cold parts, such as, e.g., columns, devices, pipelines or valves, are provided with an enclosure. The enclosure with the parts to be insulated is also called a cold box. An enclosure here is defined especially as jacketing or a shell that is suited for holding one or more components of the low-temperature air separation system and insulating them thermally against the environment. The enclosure is either itself thermally insulated or can be filled with suitable thermal insulation material.

These generally cuboidal enclosures to date have had a steel construction with a roof and side walls that are lined with sheet metal.

For insulation purposes, the cold box is conventionally filled with perlite. In the construction of the cold box, external effects, such as wind and possible earthquake, and internal effects, such as the inherent weight of the sheet metal, the internals and the pipelines as well as the perlite insulation and flushing gas pressure, are to be considered.

The object of this invention is to develop an enclosure that can be rapidly and efficiently installed and can be adapted flexibly to different dimensions of the internals to be insulated, but especially to the circumstances of the building sites.

This object is achieved according to the invention by a cold box of the initially mentioned type, in which in the direction of the height of the enclosure, the joints of the panels of one side wall all have essentially the same distance from one another.

The process according to the invention for producing an enclosure that has side walls that extend perpendicular to the base surface of the enclosure is characterized in that the side walls each are formed from several panels that each have a frame that is provided with a sheet metal lining, the panels being positioned and connected to one another.

For reasons of transport engineering, it is necessary to divide the side walls of the enclosure into several individual elements. According to the invention, this division takes place such that the side walls in the direction of the height of the enclosure, i.e., vertically, consist of several elements, hereinafter called panels.

By the division of the side walls according to the invention, the transport of the cold box is greatly facilitated since except for individual panels they all have the same height. Only the panel that is provided in the planned cold box on the lowermost or uppermost location or individual panels that are provided, for example, with special ducts have a different extension in the direction of the height of the future cold box. Preferably the maximum height of all panels is determined by the height of most of the panels, i.e., most of the panels have the same height, and the height of the other panels is less than this height.

It is advantageous if the panels of one side wall each have the same extension in the direction perpendicular to the height of the enclosure. With the same dimensioning of the panels, transportation to the erection site is facilitated. For an enclosure with a rectangular base surface, it has been proven effective to dimension the panels of one side wall such that they extend in each case over the entire length or width of the side wall. The length and width are defined here by the boundaries of the base surface. Preferably, therefore, almost all panels of one side have the same size. Generally, only the uppermost and/or the lowermost row of panels has a differing height in order especially to equalize the difference between the necessary cold box height and the height that is possible based on the grid and in order to form the pitch of the roof.

In the direction of the height of the enclosure, the panels preferably have an extension of 2 to 4 meters, especially preferably 3 meters. This preferred dimensioning of the panels avoids transport problems, for example by exceeding conventional transport widths. Thus, for example, widths up to 3 meters with standard truck transport are possible; at widths up to 3.5 meters, only a vehicle accompanying the truck transport is necessary.

Moreover, a height grid of 3 meters corresponds to the height of flights of stairs that is the maximum allowable in many regulations. Walkways that can be attached to the enclosure can thus be connected to the corresponding panels before final assembly of the enclosure, by which the degree of prefabrication is further increased.

The panels advantageously have a frame of U-sections that run peripherally on four sides, which frame is provided with lining sheet metal.

The frame of the panels is dimensioned such that the inherent weight of the cold box and the forces that occur at the erection site and that can be caused, for example, by wind or earthquakes are accommodated. Preferably the frame is executed such that the legs of the U-section each point to the inside, i.e., that the frame is bordered to the outside by the base and the legs of the U-sections. Thus, the panel has three smooth outer sides, by which a connection of the panel to adjacent panels by a screwed assembly joint is possible.

To improve the carrying capacity of the sheet metal of the lining, there are vertical stiffeners, for example in the form of L-shaped steel sections.

To accommodate horizontal forces, preferably diagonal braces are mounted on the frame. They can be made from round pipe, H-section or U-section. Especially round pipe has proven effective for this purpose since it has an especially favorable ratio of area and thus weight to buckling resistance. It is thus an optimum profile for dissipating compressive forces. Moreover, round sections in the most varied cross sections can be easily procured worldwide so that prefabricated frames can be later matched to the load influences prevailing at the erection site.

The diagonal of the round pipe can be matched to the required cross section for the same outside dimension, i.e., the same diameter, via the wall thickness. Matching to the other installations, e.g., to the piping, remains unaffected by these changes.

Alternatively, for the correspondingly small horizontal forces, stiffening can also take place without a diagonal, for this purpose via the lining sheet metal.

Preferably the frames extend over the entire length or width of one side surface of the enclosure. The inherent weight of the enclosure and the vertical forces from the external effects are then advantageously taken up only by the vertical U-sections of the frame that are located in the corners of the enclosure. Middle supports are avoided as much as possible. If the cross section of the vertical U-sections is not sufficient to accommodate the forces, the corner supports are further reinforced by welded-on sections. With few supports, the inherent weight of the enclosure is dissipated in a more concentrated manner; the individual supports each take up higher compressive forces. The tensile forces that result from effects that act externally, such as, for example, wind or earthquakes, are thus better compensated in this way, and the anchoring can be dimensioned to be smaller.

Advantageously, the sheet metal lining is steel sheet 3 to 5 mm thick. When the sheet metal thickness is fixed, a compromise between the static supporting capacity of the sheet metal, its workability and its weight must be found. A sheet metal thickness of 4 mm has proven especially favorable in this respect.

The individual panels are preferably screwed to one another. In order to achieve a gas-tight enclosure, it is then additionally necessary to seal the contact points of the panels. To do this, preferably a weld is used. It can be done with a small weld cross section since the static forces are accommodated by a screw connection, and the weld is attached only for sealing purposes.

The enclosure according to the invention compared to the prior art has numerous advantages. The enclosure can be matched to the most varied plant engineering boundary conditions, for example, different column heights, or variable dimensions of the heat exchanger blocks. In principle, cylindrical boxes can also be produced according to the invention. Engineering processing can take place in parallel by consequent separation of the space-enclosing and statistically required elements, or by the possibility of being able to easily reinforce the space-enclosing elements. The conventional processing sequences (first basic engineering, then statistical analysis, then shop drawings, and, at the end, purchase of material and work preparation) need not be observed. Extensive overlapping is possible, for example the shop drawings can be processed parallel to statistical analysis. This results in savings in processing time and thus shorter delivery times.

The cross sections and dimensions that are necessary for space enclosure, especially the U-sections of the panels, can for the most part be established independently of the specific project. The components that are dependent on the erection site can be considered via the parameter of the wall thickness of the sheet metal jacket or by additional reinforcing sections. Because most of the cross sections can be established beforehand, the panel-producing operation can purchase its material independently of the statistical analysis of the enclosure.

The panels can be prefabricated and as a result of their dimensioning can be easily transported to the erection site of the enclosure. The enclosure, moreover, has a construction based on components that are available worldwide and can thus be produced worldwide with sections that can be obtained on site without major interventions into the construction.

The invention optimizes the fabrication of the enclosure since a host of identical panels can be produced. Both in the design, statistical analysis, preparation of detailed drawings and also in the manufacture of the enclosure, the effects of repetition can be used both within the project and also encompassing the entire project. The project-specific cost for statistical analysis is distinctly reduced.

The dimensions and thus the weight of preassembled segments can be established depending on the existing crane capacities on site and the existing assembly possibilities, i.e., at a very late time. Early adaptation (in the basic phase) is no longer necessary. The welds necessary to achieve gastightness can be made up at any time since supporting connection takes place by screw unions of the panels. The utilization times of the cranes can be reduced.

BRIEF DESCRIPTION OF THE DRAWINGS

The invention and other details of the invention are explained in more detail below based on the embodiments shown in the drawings. Here:

FIG. 1 shows a partial structure of an enclosure according to the invention that is used as a cold box for holding components in a low-temperature air separation system. In the cold box, there are, for example, the low-pressure column and/or the main condenser and/or the raw argon column with the corresponding accessory parts.

The illustrated cold box has a rectangular base surface with length L and width B. The height of the cold box is its extension in a direction perpendicular to the base surface. The side walls of the cold box are assembled from a host of panels 1*a*, 2*a*, 1*b*, 2*b*. The panels 1*a* and 2*a* and 1*b* and 2*b* are each made identically and in each case extend over the entire extension L and B of the corresponding cold box side wall.

Figure 2:
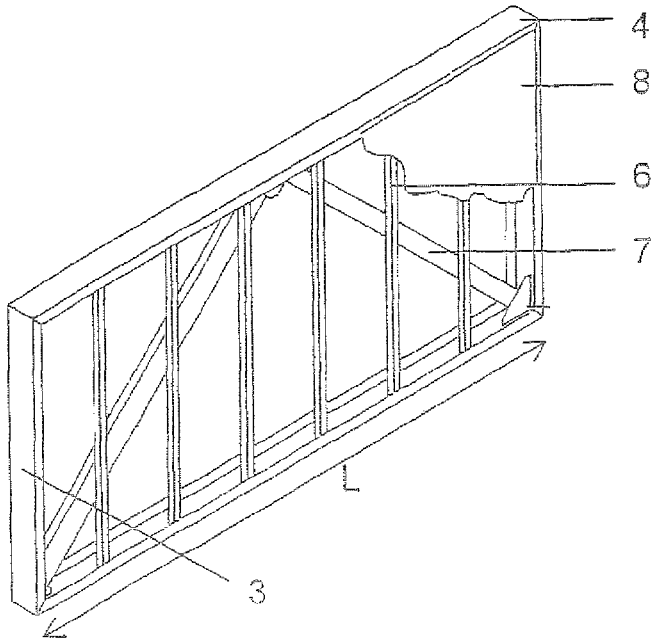
FIG. 2 shows a panel according to the invention.

FIG. 2 shows a panel in greater detail. The panel consists of a rectangular frame of U-sections 3, 4 made of steel. The length of the U-sections 4 that run horizontally in the cold box after its erection corresponds in the illustrated example to the side length L of the cold box. The panels for the sides with the width B are made accordingly. The length of the U-sections 3 that run vertically in the assembled state is preferably 3 m.

The U-sections 3, 4 are joined into a rectangular frame. Diagonals 7 of round pipe are used to dissipate the horizontal loads. The entire frame is finally lined with sheet metal 8 that has a thickness between 3 and 5 mm, preferably 4 mm, and is reinforced with the vertically arranged sections 6.

At the planned erection site of the cold box, a foundation is built on which the lowermost panels 1*a*, 1*b* are mounted. Two panels 1*a*, 1*b* that border one another on the corner are moved into position and are screwed to one another.

Regardless of the installation on the foundation, preferably in the vicinity of the foundation, panels located farther above on the base frame can be preassembled into segments.

Figure 3:
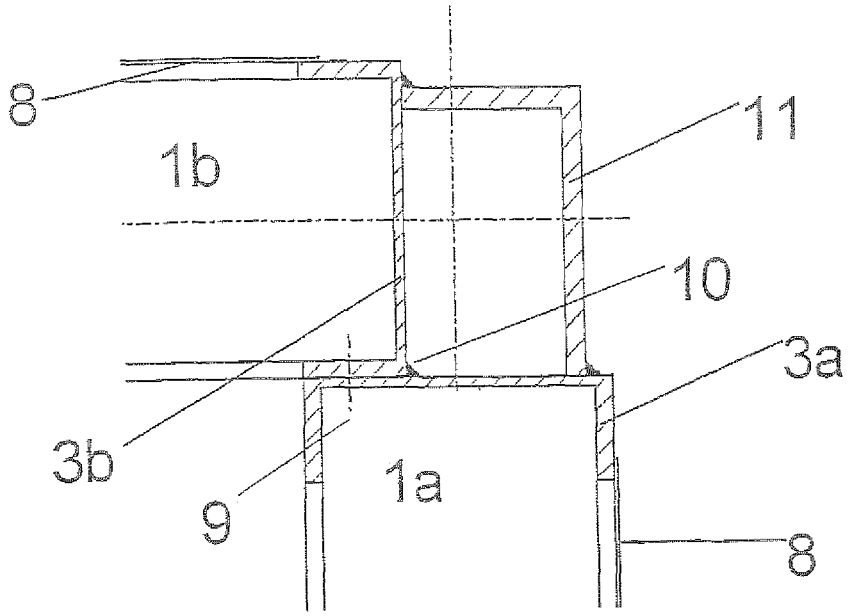
FIG. 3 shows a detailed view of the corner connection of two panels.

The connection of the panels 1*a* and 1*b* is detailed in FIG. 3. The panels 1*a* and 1*b* are arranged such that the base of the vertical U-section 3*a* of the panel 1*a* and one leg of the vertical U-section 3*b* of the panel 1*b* border one another. At the contact site, the two U-sections 3*a* and 3*b* are connected to one another via a screw connection 9. The contact point of the two U-sections 3*a* and 3*b* is then provided with a weld 10 in order to achieve a gastight connection of the two panels 1*a* and 1*b*.

Figure 1:
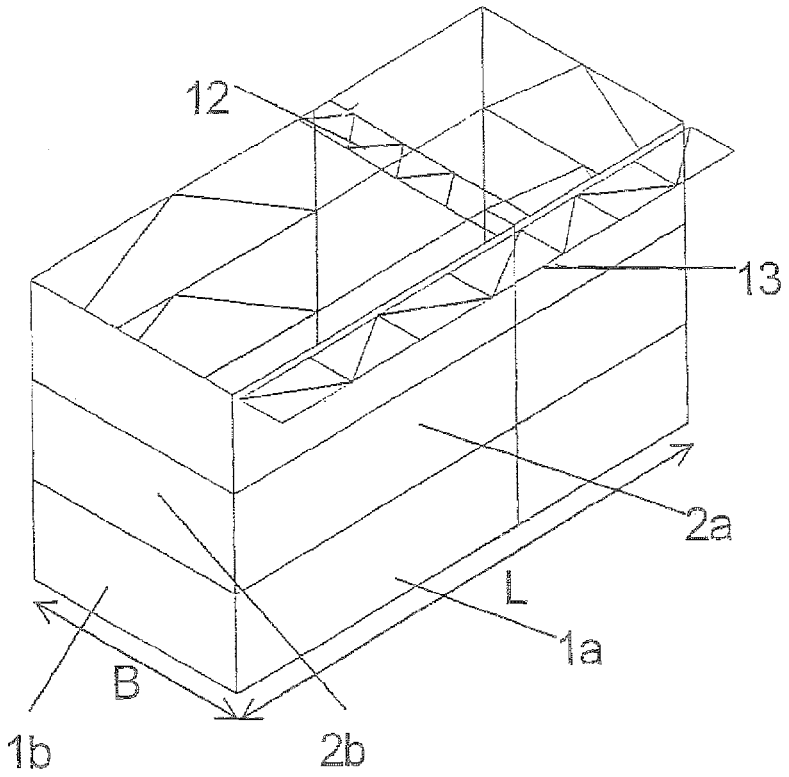
FIG. 1 shows one part of an enclosure that is assembled according to the invention from panels.

The two vertical U-sections 3*a* and 3*b* and the corresponding vertical U-sections of the overlying panels, for example of the panels 2*a* and 2*b* (FIG. 1), form the corner supports of the cold box. To reinforce the cold box corners, when statistically necessary, in addition an L-section 11 is welded on and extends over the height of several panels 1*a*, 2*a* or over the entire height H of the cold box and can be staggered according to the statistical requirements.

After completion of the lowermost panel ring 1*a*, 1*b*, the next panels 2*a*, 2*b* are positioned on the lowermost panel ring 1*a*, 1*b* and connected to it. To do this, the succeeding horizontal U-sections 4 of the lower panel 1*a* and the overlying panel 2*a* are screwed to one another. To produce a gastight cold box, the contact point of the two panels 1*a* and 1*b* is also provided with a weld. The corner connection of the panels 2*a* and 2*b* of the upper panel ring takes place in the manner explained above using FIG. 3.

If necessary, in addition, supports 12 (see FIG. 1) can be placed in the cold box and can be attached to the panels, in order to mount, for example, pipelines or other modules on them. Analogously, there can be a walkway 13 on the outside of the enclosure.

Instead of the described construction of the cold box from individual panels 1*a*, 1*b*, 2*a*, 2*b*, prefabricated segments that consist of several panels can also be used.

Figure 4:
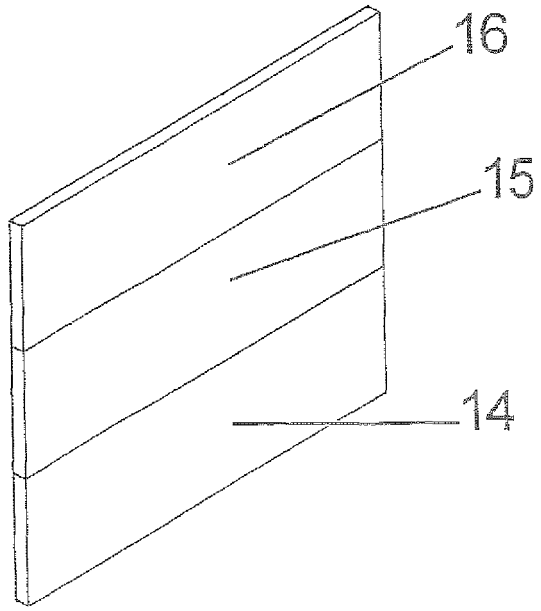
FIG. 4 shows a subsection prefabricated from several panels.

FIG. 4 shows, for example, a prefabricated element consisting of three panels 14, 15, 16, a so-called subsection. The panels 14, 15, 16 are screwed to one another before installation in the cold box, and the connecting points are sealed with welds. The complete subsection that consists of the three panels 14, 15, 16 is then installed as a single part in the side wall of the cold box. The number of panels of a subsection can be chosen according to conditions at the building site, e.g., depending on the existing crane capacity.

Figure 5:
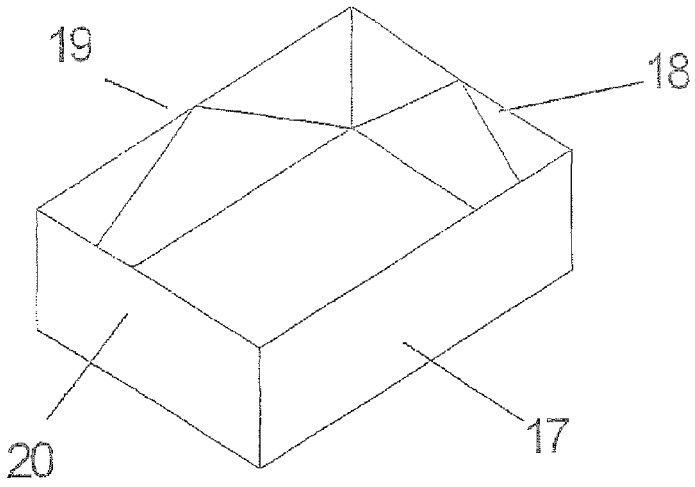
FIG. 5 shows a prefabricated ring that consists of several panels.

FIG. 5 likewise shows a segment that has been prefabricated from several panels 17, 18, 19, 20. The individual panels 17, 18, 19, 20 in this version are not located on top of one another, but rather next to one another and are connected to one another such that they form a ring according to the size of the cold box. The complete ring is then positioned at the intended site on the cold box and is screwed to the underlying panels.

Figure 6:
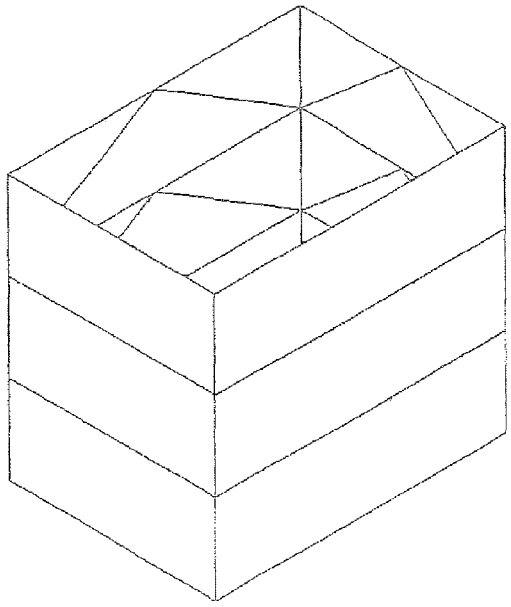
FIG. 6 shows a section prefabricated from several panels according to the invention.
Figure 7:
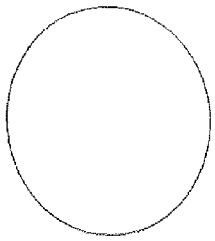
FIG. 7 shows a cross sectional view of a of a round pipe diagonal.

FIG. 6 shows a third variant of prefabrication. One section of the enclosure that is being formed is prefabricated from several panels. The panels lying next to one another form the outside dimensions L and B of the enclosure; the panels on top of one another form part of the overall height. The section can be built either from several panels, from prefabricated subsections, or rings. The height of the section is determined primarily by the existing crane capacities.

Of course, system parts or accessory parts, for example pipelines, cable shafts, valves or walkways and supports can be mounted on the prefabricated elements as well as to individual panels before installation in the cold box.

In addition to the above-described approach, to erect the enclosure at the building site and to successively install the internals, the illustrated concept is also suited for the so-called packaged unit variant, i.e., installation of the enclosure, the installation of internals and piping horizontally, and subsequent transport of the entire cold box to the erection site.

The invention claimed is:

1. A process for producing an enclosure for parts of a low-temperature air separation system, the enclosure having a base surface and side walls that extend perpendicular to said base surface, said process comprising: forming several panels, each panel comprising a metal frame (3, 4) and a sheet metal lining (8), wherein, in each of said panels, said frame is attached to the periphery of said sheet metal lining, said frames being provided with diagonal braces made from round pipes mounted on said frames, attaching one or more walkways to panels of said enclosure before assembly of the enclosure, then connecting said panels (3, 4) to one another to form the enclosure around one or more parts of the low-temperature air separation system; and then filling the enclosure with thermal insulation material.

2. The process according to claim 1, wherein the panels are screwed to one another so that a supporting connection is formed.

3. The process according to claim 1, wherein a segment is preassembled from at least two panels (14, 15, 16), and the segment is integrated into the side wall.

4. The process according to claim 1, wherein before installation in the side wall, system parts or accessory parts (12, 13) are mounted on a panel.

5. The process according to claim 1, wherein each of said frames (3, 4) comprises four U-sections (3, 4) that run peripherally on four sides of the frame, each of said U-sections having a base and two legs which together form the U-shape.

6. The process according to claim 1, wherein the sheet metal lining is made of steel sheets having a thickness of 3 to 5 mm thick.

7. The process according to claim 5, wherein the legs of the U-sections each point towards an inside of the panel such that the frame is bordered to an outside by the base and the legs of each U-section.

8. The process according to claim 1, wherein where the frames contact one another at the corners of the enclosure the frames are further provided with vertical stiffeners in the form of L-shaped steel sections.

9. The process according to claim 1, wherein each of said frames (3, 4) comprises four U-sections (3, 4) that run peripherally on four sides of the frame, each of said U-sections each having a base and two legs which together form the U-shape.

10. The process according to claim 1, wherein each of the side walls are formed from several panels connected to one another.

11. The process according to claim 1, wherein each of the side walls of the enclosure are divided several individual panels, and the division of the side walls into several panels is in the vertical direction.

12. The process according to claim 11, wherein said enclosure has a rectangular base surface with borders that define the length and the width of the enclosure, and the panels (1*a*, 1*b*, 2*a*, 2*b*) of one side wall in each case extending over the entire length or width of the side wall.

13. The process according to claim 1, wherein said low-temperature air separation system comprises a low-pressure column and/or a main condenser and/or a raw argon column, and said enclosure is constructed around said low-pressure column and/or a main condenser and/or a raw argon column.

14. The process according to claim 1, wherein the frame of each panel is reinforced with vertically arranged sections (6).

15. The process according to claim 3, wherein before installation in the side wall, system parts or accessory parts (12, 13) are mounted on a segment.

16. The process according to claim 1, wherein the frames are further provided with diagonal braces mounted on the frames, and the frame of each panel is reinforced with vertically arranged sections (6).

17. The process according to claim 15, wherein adjacent panels at a corner of the enclosure are arranged such that the base of a vertical U-section of one panel and one leg of a vertical U-section of the other panel border contact one another, and at this contact the two vertical U-sections are connected to one another via screw connections.

18. The process according to claim 1, wherein in the direction of the height of the enclosure, joints of the panels (1*a*, 1*b*, 2*a*, 2*b*) of one side wall all have the same distance from one another.

19. The process according to claim 1, wherein the panels (1*a*, 2*a*) of one side wall each have the same extension in the direction perpendicular to the height of the enclosure.

20. The process according to claim 1, wherein said enclosure has a rectangular base surface with borders that define the length and the width of the enclosure, and the panels (1*a*, 1*b*, 2*a*, 2*b*) of one side wall in each case extending over the entire length or width of the side wall.

21. The process according to claim 1, wherein in the direction of the height of the enclosure, the panels have an extension of 2 to 4 meters.

22. A process for producing an enclosure for parts of a low-temperature air separation system, the enclosure having a base surface and side walls that extend perpendicular to said base surface, said process comprising:

forming several panels, each panel comprising a metal frame (3, 4) and a sheet metal lining (8), wherein, in each of said panels, said frame is attached to the periphery of said sheet metal lining, then connecting said panels (3, 4) to one another to form the enclosure around one or more parts of the low-temperature air separation system; and then filling the enclosure with thermal insulation material, said process further comprising attaching one or more walkways to panels of said enclosure before assembly of the enclosure.

23. A process for producing an enclosure for parts of a low-temperature air separation system, the enclosure having a base surface and side walls that extend perpendicular to said base surface, said process comprising: forming several panels, each panel comprising a metal frame (3, 4) and a sheet metal lining (8), wherein, in each of said panels, said frame is attached to the periphery of said sheet metal lining, then connecting said panels (3, 4) to one another to form the enclosure around one or more parts of the low-temperature air separation system; attaching one or more walkways to panels of said enclosure before assembly of the enclosure, and then filling the enclosure with thermal insulation material, wherein the panels are screwed to one another so that a supporting connection is formed, and after said panels are screwed together, contact points of the panels are sealed by means of a weld to make the enclosure gas-tight.

24. A process for producing an enclosure for parts of a low-temperature air separation system, the enclosure having a base surface and side walls that extend perpendicular to said base surface, said process comprising: forming several panels, each panel comprising a metal frame (3, 4) and a sheet metal lining (8) wherein in each of said panels said frame is attached to the periphery of said sheet metal lining, attaching one or more walkways to panels of said enclosure before assembly of the enclosure, then connecting said panels (3, 4) to one another to form the enclosure around one or more parts of a low-temperature air separation system, wherein the panels are connected by screwing the panels to one another so that a supporting connection is formed, and, after said panels are screwed together, contact points of the panels are sealed by means of a weld to make the enclosure gas-tight; and then filling the enclosure with thermal insulation material.

25. The process according to claim 24, wherein each of said frames (3, 4) comprises four U-sections (3, 4) that run peripherally on four sides of the frame, each of said U-sections each having a base and two legs which together form the U-shape.

* * * * *